US007428313B2

(12) United States Patent
Carney

(10) Patent No.: US 7,428,313 B2
(45) Date of Patent: Sep. 23, 2008

(54) METHOD FOR CORRECTING SOUND FOR THE HEARING-IMPAIRED

(75) Inventor: Laurel H. Carney, Syracuse, NY (US)

(73) Assignee: Syracuse University, Syracuse, NY (US)

( * ) Notice: Subject to any disclaimer, the term of this patent is extended or adjusted under 35 U.S.C. 154(b) by 811 days.

(21) Appl. No.: 11/062,368

(22) Filed: Feb. 22, 2005

(65) Prior Publication Data

US 2005/0185798 A1 Aug. 25, 2005

Related U.S. Application Data

(60) Provisional application No. 60/546,405, filed on Feb. 20, 2004.

(51) Int. Cl.
*H04R 25/00* (2006.01)

(52) U.S. Cl. ..... 381/312; 607/55

(58) Field of Classification Search ..... 381/312; 600/25, 559; 607/55, 56, 136, 137; 623/10
See application file for complete search history.

(56) References Cited

U.S. PATENT DOCUMENTS 5,233,665 A * 8/1993 Vaughn et al. ..... 381/320
2007/0270949 A1* 11/2007 Paolini et al. ..... 623/10
2008/0033317 A1* 2/2008 Elberling ..... 600/559

OTHER PUBLICATIONS

Carney et al., A hearing-aid signal-processing scheme based on the temporal aspects of compression, Absract in Program of the 147th Meeting of the Acoustical Society of America, 66 pages (May 2004).*

* cited by examiner

*Primary Examiner*—Walter F Briney, III
(74) *Attorney, Agent, or Firm*—Christopher R. Pastel; Pastel Law Firm

(57) ABSTRACT

A method for correcting sound for the hearing impaired includes analyzing an incoming sound into frequency channels and computing a group delay of each of the frequency channels that is expected in a healthy ear. A correction is defined as a percentage less than 100% of the group delay (GD) that a given impaired ear has compared to the group delay of the healthy ear. The amount of delay for the correction as a function of time is computed for each frequency channel, which delay is imposed on each frequency channel. The signal levels are scaled to adjust for audibility, after which the delayed and scaled signals from all frequency channels are combined into an outgoing sound.

17 Claims, 8 Drawing Sheets

Fig. 2A
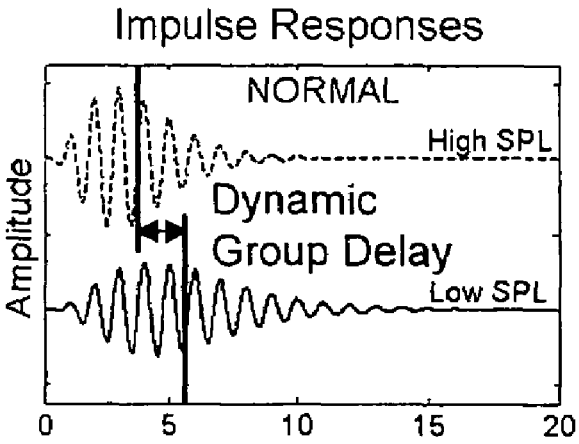
Fig. 2B
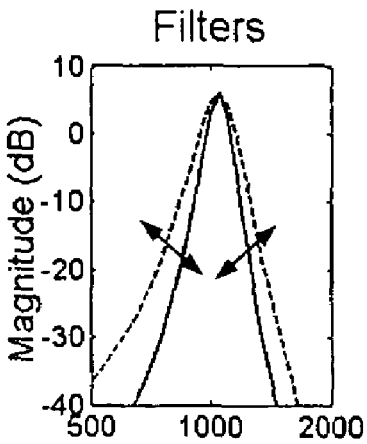
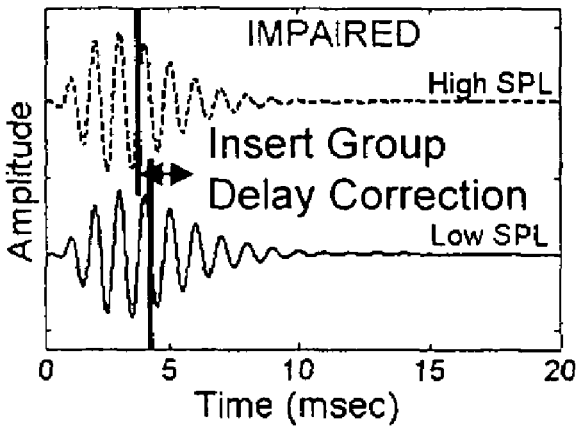
Fig. 2C
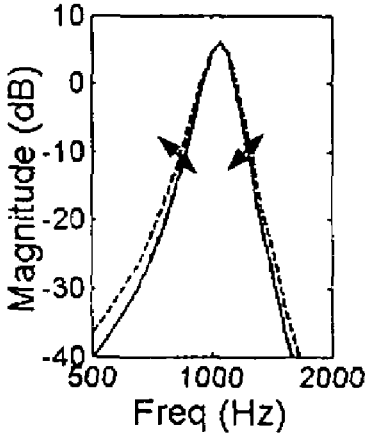
Fig. 2D

METHOD FOR CORRECTING SOUND FOR THE HEARING-IMPAIRED

CROSS-REFERENCE TO RELATED APPLICATIONS

This application claims priority from U.S. application Ser. No. 60/546,405 filed on Feb. 20, 2004 and entitled CORRECTING SOUND FOR THE HEARING-IMPAIRED USING A PHYSIOLOGICALLY-BASED SPATIO-TEMPORAL SIGNAL-PROCESSING SCHEME, incorporated herein by reference.

FIELD OF THE INVENTION

This invention relates generally to the field of hearing aids, and more particularly to a method for correcting sound for the hearing impaired using a spatio-temporal signal processing scheme.

BACKGROUND OF THE INVENTION

Current hearing-aid technology focuses on amplification, which is a manipulation of the magnitude (amplitude) spectrum of a sound. Typical hearing aids amplify to compensate for loss of gain and/or sensitivity in the cochlea, but they do not purposefully manipulate the phase spectrum. Instead, most hearing aids attempt to restore the quality of sound for hearing-impaired listeners by amplifying the sound in a frequency-dependent scheme that is based on a listener's hearing ability (thresholds) at different frequencies, i.e., if there is more hearing loss at high frequencies, more amplification is applied at high frequencies. Additionally, the amount of amplification is often varied with the sound-level in a compressive manner in order to compress the wide dynamic range of sound into the limited dynamic range of hearing-impaired listeners, e.g., the WDRC (wide dynamic range compression) strategy.

Most amplification strategies are variations and/or combinations of different schemes for controlling gain across frequency, i.e., using different numbers of frequency channels that can be independently controlled, and for varying the compression across the frequency channels. All of these strategies are focused on manipulating the magnitude spectrum of the acoustic stimulus, but they do not include purposeful manipulation of the phase spectrum.

In the past decade, WDRC hearing aids have gained some success in restoring normal loudness perception in hearing-impaired listeners by giving low-level inputs relatively more gain than high-level inputs. However, discrimination and identification of complex sounds, such as speech, cannot be fully restored by the adjustment of gain, i.e., the magnitude spectrum.

In the healthy ear, the phases of phase-locked auditory-nerve (AN) responses change systematically with level. Discharge times across fibers tuned to a range of frequencies near a stimulus frequency become more similar as the input level is increased and less so when the input level is decreased. In the impaired ear, peripheral filters are broader, and therefore response times are more similar across frequencies even at low input levels. The properties of the phase spectrum remain to be incorporated into signal-processing strategies.

SUMMARY OF THE INVENTION

Briefly stated, a method for correcting sound for the hearing impaired includes analyzing an incoming sound into frequency channels and computing a group delay of each of the frequency channels that is expected in a healthy ear. A correction is defined as a percentage less than 100% of the group delay (GD) that a given impaired ear has compared to the group delay of the healthy ear. The amount of delay for the correction as a function of time is computed for each frequency channel, which delay is imposed on each frequency channel. The signal levels are scaled to adjust for audibility, after which the delayed and scaled signals from all frequency channels are combined into an outgoing sound.

The purpose of this study is to introduce the potential application of a new signal-processing strategy, spatiotemporal pattern correction (SPC), which is based on our knowledge of the level-dependent temporal response properties of auditory-nerve (AN) fibers in normal and impaired ears. SPC manipulates the temporal aspects of different frequency channels of sounds in an attempt to compensate for the loss of nonlinear properties in the impaired ear. Quality judgments and intelligibility measures of speech processed at various SPC strengths were obtained on a group of normal-hearing listeners and listeners with hearing loss. In general, listeners with hearing loss preferred sentences with some level of SPC processing, whereas normal-hearing listeners preferred the quality of the unprocessed sentences. Benefit from SPC on the nonsense syllable test varied greatly across phonemes and listeners. These preliminary findings suggest that SPC, a temporally based algorithm designed to improve the perception of speech for listeners with hearing loss, has potential to be useful to listeners with hearing loss. However, before this strategy can be integrated in hearing aids, a more comprehensive study on the benefit of SPC for listeners with different degrees and configurations of hearing loss is needed.

The phase spectrum of complex sounds was manipulated based on knowledge of the level-dependent temporal response properties of auditory-nerve (AN) fibers in normal and impaired ears. This approach attempts to correct AN response patterns by introducing time-varying phase delays that differ across frequency. Sentences from the Hearing in Noise Test (HINT) and vowel-consonant (VC) syllables from the nonsense syllable test (NST) were used as stimuli. Stimuli were processed at different corrections, i.e., maximum phase delays introduced to the input signal. In the first half of the study, hearing-impaired (HI) and normal-hearing (NH) listeners judged the quality of HINT sentences. Different HI listeners preferred stimuli processed at different corrections, whereas NH listeners preferred less corrected stimuli. In the second half of the study, VC syllables were presented to HI listeners. Listeners' speech intelligibility and clarity rating were measured. In general, correction improved HI listeners' speech intelligibility and clarity rating for some VCs.

By introducing different phase delays across frequency in the input sound, the strategy of the present invention attempts to correct the abnormal temporal response pattern without changing the magnitude spectrum of the sound. Therefore, this approach differs significantly from the WDRC approach and has the potential of increasing the benefit of WDRC hearing aids. The current study tested the hypothesis that manipulating the stimulus phase spectrum will improve speech intelligibility and clarity for hearing-impaired (HI) listeners.

Time-varying phase corrections were based on an AN model developed by Heinz et al. (Heinz, M. G., Zhang, X., Bruce, I. C., & Carney, L. H., "Auditory-nerve model for predicting performance limits of normal and impaired listeners", *Acoustics Research Letters Online,* 2, 91-96 (2001), incorporated herein by reference) that simulates the level-dependent fine-structure of AN temporal responses at a particular frequency. To measure the effectiveness of the new strategy, sound quality and speech intelligibility were chosen as two primary indices. Both normal-hearing (NH) and HI listeners with sensorineural hearing loss participated in this study.

For the first half of the study, four sentences from the Hearing in Noise Test (HINT) were pre-processed at ten corrections, which specified the maximal phase delay that was introduced to the input signal. Unprocessed sentences were also included, and RMS levels of all stimuli were matched. A two-alternative forced choice paradigm was used; two corrections were presented within one pair of stimuli. Listeners' preferred corrections were documented.

For the second half of the study, stimuli consisted of sixteen vowel-consonant (VC) syllables, a subset of the nonsense syllable test (NST), spoken by a female speaker. These VCs were processed at four corrections, including listeners' preferred levels obtained from the first half of the study; uncorrected VCs were also presented. Listeners were instructed to press one of sixteen buttons on a response box that corresponded to the speech signal they heard. They were also asked to rate the clarity of each signal on a ten-point scale. The specific speech stimulus presented, the listener's response, and the clarity rating on each trial were recorded.

Results showed that different HI listeners preferred signals processed at different corrections. For some VCs (e.g., /iθ/, /if/, /iz/), speech intelligibility scores and clarity ratings were higher for corrected stimuli. This finding suggests a promising algorithm for speech processing in hearing aids.

The technology of the present invention involves purposefully manipulating the phase (or temporal) properties of sounds in order to correct the neural signals from the impaired ear to better match those from a healthy ear. This manipulation is referred to as "correction", making an analogy to the term used for the "correction" of eyeglasses, which is also a purposeful distortion of the sensory input made in an attempt to restore a normal neural response.

The proposed strategy focuses on a novel strategy for manipulating the phase spectrum of sound by introducing frequency and time dependent delays. The general strategy is to attempt to mimic the temporal response properties of the healthy ear in the ear of the hearing-impaired listener. Impairment causes changes in the tuning properties of the inner ear that change the timing of neural responses as compared to those in the healthy ear. In many situations, these changes result in a reduced latency in the impaired ear as compared to the healthy ear, due to broadening of the filters in the impaired ear. By introducing corrections in the form of delays to different frequency components of the sound, we can attempt to restore or correct the spectrotemporal response patterns.

Because the healthy ear is highly nonlinear, with its tuning properties changing with sound level and across frequency, this correction is by necessity nonlinear because the amount of correction depends upon sound level. However, we can compute the desired corrections for each frequency channel as a function of time. The amount of detail about the nonlinear response properties of the healthy ear that is included in the correction can be varied depending upon the desired accuracy or level of sophistication of the correction scheme. The corrections to the temporal aspects of a sound that are described here can also be combined with schemes that focus on the amplification, as described below.

According to an embodiment of the invention, a method for correcting sound for the hearing impaired includes the steps of (a) analyzing an incoming sound into a plurality of signals, one of the signals in each of a plurality of frequency channels; (b) computing a group delay (GD) of each of the frequency channels that is expected in a healthy ear; (c) defining a correction as (100%)/(% GD), where (% GD) is defined as a percentage less than 100% of the group delay (GD) that a given impaired ear has compared to the group delay of the healthy ear; (d) computing, in each of the frequency channels, an amount of delay required for the correction as a function of time for each of the frequency channels, based on the correction from step (c) and the group delays computed in step (b); (e) imposing the amount of delay on each signal passing through each frequency channel; (f) scaling the signal level of each signal to adjust audibility; and (g) recombining the delayed and scaled signals from all frequency channels into an outgoing sound.

According to an embodiment of the invention, a program storage device readable by a machine, tangibly embodying a program of instructions executable by the machine to perform method steps for correcting sound for the hearing impaired, includes the method steps of (a) analyzing an incoming sound into a plurality of signals, one of the signals in each of a plurality of frequency channels; (b) computing a group delay (GD) of each of the frequency channels that is expected in a healthy ear; (c) defining a correction as (100%)/(% GD), where (% GD) is defined as a percentage less than 100% of the group delay (GD) that a given impaired ear has compared to the group delay of the healthy ear; (d) computing, in each of the frequency channels, an amount of delay required for the correction as a function of time for each of the frequency channels, based on the correction from step (c) and the group delays computed in step (b); (e) imposing the amount of delay on each signal passing through each frequency channel; (f) scaling the signal level of each signal to adjust audibility; and (g) recombining the delayed and scaled signals from all frequency channels into an outgoing sound.

According to an embodiment of the invention, an article of manufacture includes a computer usable medium having computer readable program code means embodied therein for correcting sound for the hearing impaired, the computer readable program code means in the article of manufacture including (a) computer readable program code means for causing a computer to analyze an incoming sound into a plurality of signals, one of the signals in each of a plurality of frequency channels; (b) computer readable program code means for causing the computer to compute a group delay (GD) of each of the frequency channels that is expected in a healthy ear; (c) computer readable program code means for causing the computer to define a correction as (100%)/(% GD), where (% GD) is defined as a percentage less than 100% of the group delay (GD) that a given impaired ear has compared to the group delay of the healthy ear; (d) computer readable program code means for causing the computer to compute, in each of the frequency channels, an amount of delay required for the correction as a function of time for each of the frequency channels; (e) computer readable program code means for causing the computer to impose the amount of delay on each signal passing through each frequency channel; (f) computer readable program code means for causing the computer to scale the signal level of each signal to adjust audibility; and (g) computer readable program code means for causing the computer to recombine the delayed and scaled signals from all frequency channels into an outgoing sound.

BRIEF DESCRIPTION OF THE DRAWINGS

FIGS. 2A-2D show the relationship between group delay and phase properties of the cochlear filter.

DETAILED DESCRIPTION OF THE PREFERRED EMBODIMENT

Figure 1:
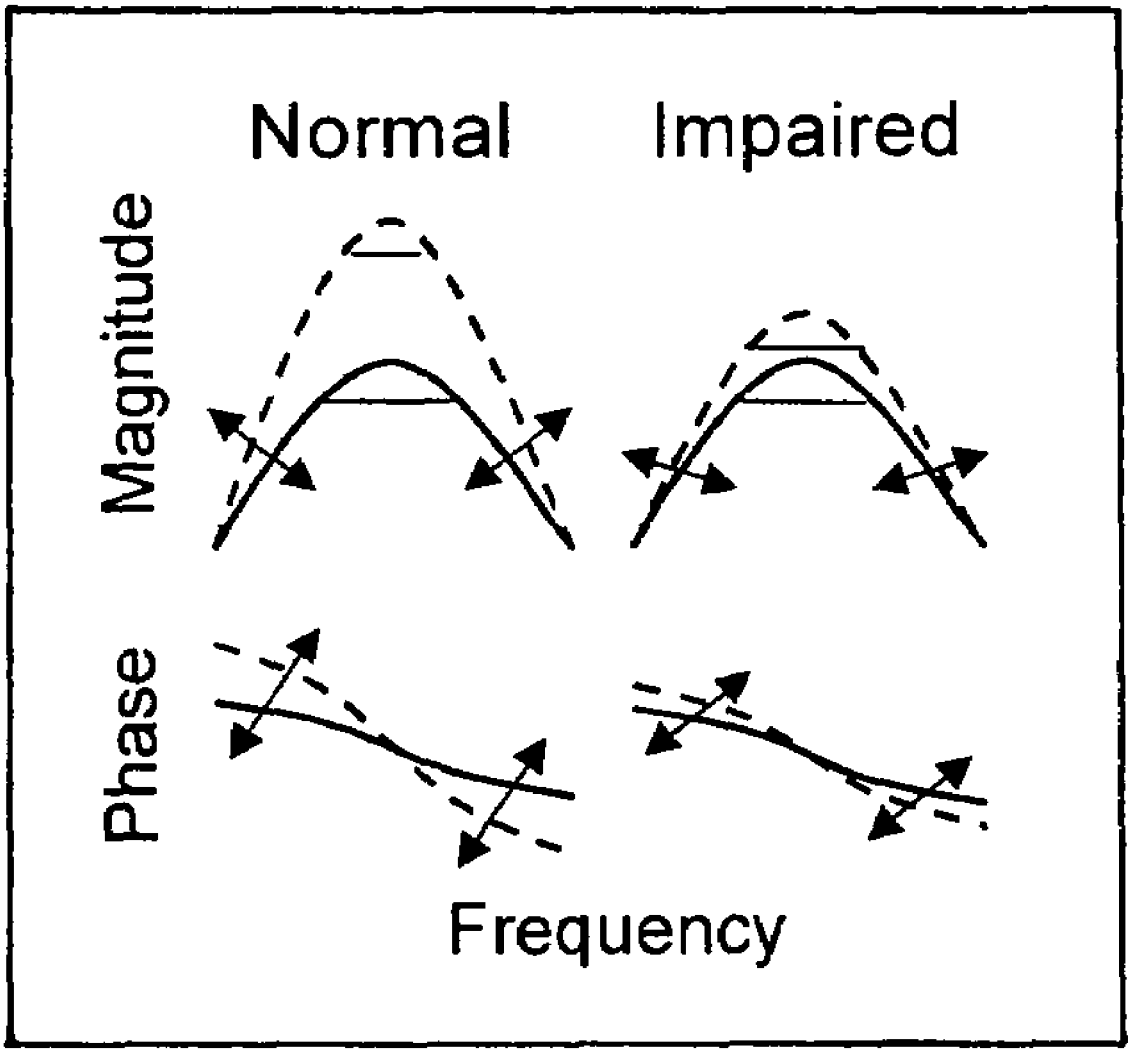
FIG. 1 shows a schematic illustration of level-dependent changes in both magnitude and phase properties of peripheral filters.

According to an embodiment of the present invention, spatiotemporal pattern correction (SPC) is a signal-processing strategy based on the nonlinear properties of the cochlea. It is known that normal-hearing listeners have sharp peripheral filters, whereas filters are much broader in listeners with hearing loss. When peripheral filters change their shape with input level, the phase properties of the filters also change (FIG. 1). In normal-hearing listeners, tuning is sharp for low-level input sounds, and broadens as the input level increases. These dynamic changes in tuning between low- and high-level input sounds may play a role in normal-hearing listeners' loudness perception and frequency selectivity. In listeners with hearing loss, the sharpness of tuning degrades with increases in hearing loss. The tuning in an ear with mild to moderate cochlear impairment for low-level input sounds is broader than in a normal ear. Tuning in an impaired ear at levels near threshold resembles tuning in a normal ear for high-level input sounds. The broadening of filters in the impaired ear has been attributed to damage in outer hair cell (OHC) function and has been shown to decrease the recognition of vowels and/or consonants.

Referring to FIG. 1, the schematic illustration of level-dependent changes in both magnitude and phase properties of peripheral filters is shown. Solid lines represent filter properties at high sound pressure levels (SPLs), and dashed lines represent low SPLs. The gain and bandwidth vary more with level in the normal ear than in the impaired ear. Similarly, changes in the phase properties of the filter vary more as a function of sound level in the normal ear than in the impaired.

Referring to FIGS. 2A-2D, the relationship between group delay and phase properties of the cochlear filter is shown. In FIGS. 2A and 2C, impulse responses of filters in the normal (FIG. 2A) and impaired (FIG. 2C) periphery are shown. The duration of the build-up of the filter's response depends upon how sharply tuned the filter is, with FIG. 2B showing the filter function corresponding to FIG. 2A and FIG. 2D showing the filter function corresponding to FIG. 2C. Broad filters have short build-up times, whereas sharp filters have a long build-up time. The build-up time is proportional to the group delay (GD); the vertical lines show the group delay approximation for gammatone filters used in the SPC system. In the normal ear, the actual group delay constantly fluctuates between the low- and high-SPL group-delay values, as represented by the double-headed arrow labeled dynamic group delay in FIG. 2A. In the impaired ear, the group delay varies much less across SPLs as can be seen in FIG. 2C where the vertical lines are closer to each other. However, by adding a dynamic delay, i.e., the correction as represented by the double-headed arrow in FIG. 2C, the normal dynamic group delay can be approximated on the output of the impaired filter.

The bandwidth of a filter also affects the phase properties that are related to the latency of the filter's response, or to its group delay. The duration of the build-up of a cochlear filter's response depends upon how sharply tuned the filter is.

In listeners with hearing loss, the lack of the dynamic change in phase over input level could explain some of their poor differentiation of subtle contrasts embedded in speech. The most common approach used in the hearing-aid industry to compensate for the reduction in the nonlinear properties of the impaired ear is wide-dynamic-range-compression (WDRC). This level-based strategy, however, does not compensate for the loss of nonlinearity due to reduced phase delays between low- and high-level input sounds.

WDRC has been widely accepted as an efficient and effective signal-processing strategy. It is a gain-based strategy in that it provides more gain for low input levels than for high input levels. It is designed to improve loudness perception and to ensure that the long-term variation of speech sounds is maintained within a range most comfortable to the listener. Because of the nature of compression, the range of output intensity is narrow in WDRC instruments regardless of the input level. As a result, there is a reduction in spectral peak-to-valley contrasts in speech. This loss of contrast in dynamic cues changes the relative amplitude between vowels and consonants and reduces speech recognition for listeners with hearing loss, especially for high-level speech inputs and for high WDRC compression ratios. This problem is conceivably most prominent in listeners with severe to profound loss, because they require high gain and/or strong compression.

SPC, on the other hand, introduces different delays across frequency channels in the input sound in an attempt to "correct" the abnormal spatiotemporal response pattern without changing the magnitude spectrum of the sound. The delay is introduced so that responses for low- versus high-level input sounds in an impaired cochlea will be more like those in a normal cochlea. Although both the prior art WDRC and the present invention SPC attempt to correct for the loss of nonlinearities in the impaired cochlea, the approach of each is very different. WDRC is gain-based, whereas SPC is based on temporal information. Thus, there is also the potential that the two strategies may provide greater benefit when combined.

During the experiments performed to verify the present invention, we evaluated how listeners with normal hearing and with hearing loss perceive the quality and intelligibility of SPC-processed speech. To our knowledge, this is the first investigation to assess the feasibility of a signal-processing strategy based on nonlinear temporal properties. Benefit in listeners' performance due to SPC would suggest that the new signal-processing strategy has the potential to be implemented into future hearing-aid technology.

Experiment and results. A total of 18 listeners (6 normal-hearing and 12 listeners with sensorineural hearing loss) participated in this study. Normal-hearing listeners (2 male, 4 female) were 20 to 57 years of age and had hearing thresholds less than 20 dB HL at the octave frequencies between 250 and 4000 Hz (ANSI, 1989). Of the 12 listeners with hearing loss (5 male, 7 female), 24 to 83 years of age, 10 had a mild to moderate sloping sensorineural hearing loss and 2 had a mild to severe mixed hearing loss, which was consistent with their case history, middle-ear immittance measures, and air- and bone-conduction results. See Table 1 for individual listener's hearing thresholds.

TABLE 1

Pure-tone air conduction thresholds in dB HL for 6 normal-hearing listeners (NH) and 12 listeners with hearing loss (HI).

| | | Frequency (Hz) | | | | | | | | |
|---|---|---|---|---|---|---|---|---|---|---|
| Listener | | 250 | 500 | 1000 | 1500 | 2000 | 3000 | 4000 | 6000 | 8000 |
| NH-1 | R | 5 | −5 | 10 | | 15 | 5 | 15 | 35 | 30 |
| | L | 5 | 0 | 10 | | 0 | 5 | 15 | 25 | 25 |
| NH-2 | R | 0 | 0 | 10 | | 5 | 0 | 0 | 5 | 10 |
| | L | 0 | 0 | 0 | | 0 | 5 | 5 | 10 | 5 |
| NH-3 | R | 5 | 5 | 5 | | 0 | 15 | 15 | 25 | 15 |
| | L | 5 | 5 | 5 | | 5 | 5 | 10 | 25 | 15 |
| NH-4 | R | 15 | 5 | 15 | | −5 | −5 | 5 | 5 | 5 |
| | L | 15 | 5 | 5 | | 0 | −5 | −5 | −5 | 10 |
| NH-5 | R | 20 | 15 | 15 | | 0 | 5 | 10 | 10 | 10 |
| | L | 10 | 10 | 15 | | 0 | 5 | 15 | 5 | 10 |
| NH-6 | R | 5 | 5 | 5 | | 10 | | 5 | 0 | 5 |
| | L | 10 | 10 | 10 | | 10 | | 5 | 5 | 5 |
| *HI-1 | R | 20 | 20 | 45 | | 55/30 | 55/30 | 70/35 | 75 | 75 |
| | L | 25/0 | 15 | 35 | | 25 | 35 | 35 | 55 | 65 |
| *HI-2 | R | 40/5 | 60/15 | 70/25 | | 80/45 | | 90/75 | | NR |
| | L | 95 | NR | NR | | NR | | NR | | NR |
| HI-3 | R | 75 | 70 | 60 | | 50 | 45 | 55 | 65 | 70 |
| | L | 20 | 20 | 35 | | 40 | 45 | 55 | 70 | 85 |
| HI-4 | R | 45 | 50 | 55 | | 70 | 65 | 75 | 70 | 80 |
| | L | 45 | 50 | 65 | | 80 | 65 | 65 | 70 | 75 |
| HI-5 | R | 30 | 25 | 25 | | 55 | 60 | 65 | 100 | 90 |
| | L | 20 | 25 | 30 | | 55 | 60 | 70 | 90 | 85 |
| HI-6 | R | 30 | 25 | 30 | | 55 | 50 | 55 | 65 | 70 |
| | L | 35 | 35 | 40 | | 55 | 60 | 60 | 80 | 75 |
| HI-7 | R | 30 | 30 | 50 | | 45 | 35 | 50 | 45 | 55 |
| | L | 20 | 30 | 45 | | 40 | 40 | 40 | 50 | 75 |
| HI-8 | R | 55 | 45 | 50 | | 45 | 40 | 50 | 75 | 80 |
| | L | 45 | 30 | 45 | | 50 | 60 | 70 | 75 | 70 |
| HI-9 | R | 50 | 45 | 50 | | 45 | 40 | 50 | 50 | 80 |
| | L | 50 | 45 | 55 | | 55 | 50 | 50 | 65 | 70 |
| HI-10 | R | 25 | 15 | 15 | | 25 | | 35 | 55 | 65 |
| | L | 15 | 20 | 15 | | 30 | | 40 | 55 | 60 |
| HI-11 | R | 20 | 15 | 20 | 20 | 45 | | 50 | 40 | 50 |
| | L | 15 | 10 | 15 | 30 | 55 | | 60 | 55 | 60 |
| HI-12 | R | 10 | 10 | 15 | 15 | 40 | | 45 | 45 | 50 |
| | L | 10 | 10 | 20 | 25 | 50 | | 45 | 60 | 60 |

*Listeners HI-1 and HI-2 have a mixed hearing loss.
Air conduction (AC) and bone conduction (BC) thresholds are displayed as AC/BC.
NR refers to "no response" at the limits of the GSI-16 audiometer (105 dB HL).

Three normal-hearing listeners and ten listeners with hearing loss participated in Experiment 1. Data from one listener with hearing loss was excluded from Experiment 1 because the listener could not perform the task. In Experiment 2 four normal-hearing listeners and five listeners with hearing loss participated. One normal-hearing listener and three listeners with hearing loss were participants in both experiments.

Figure 3:
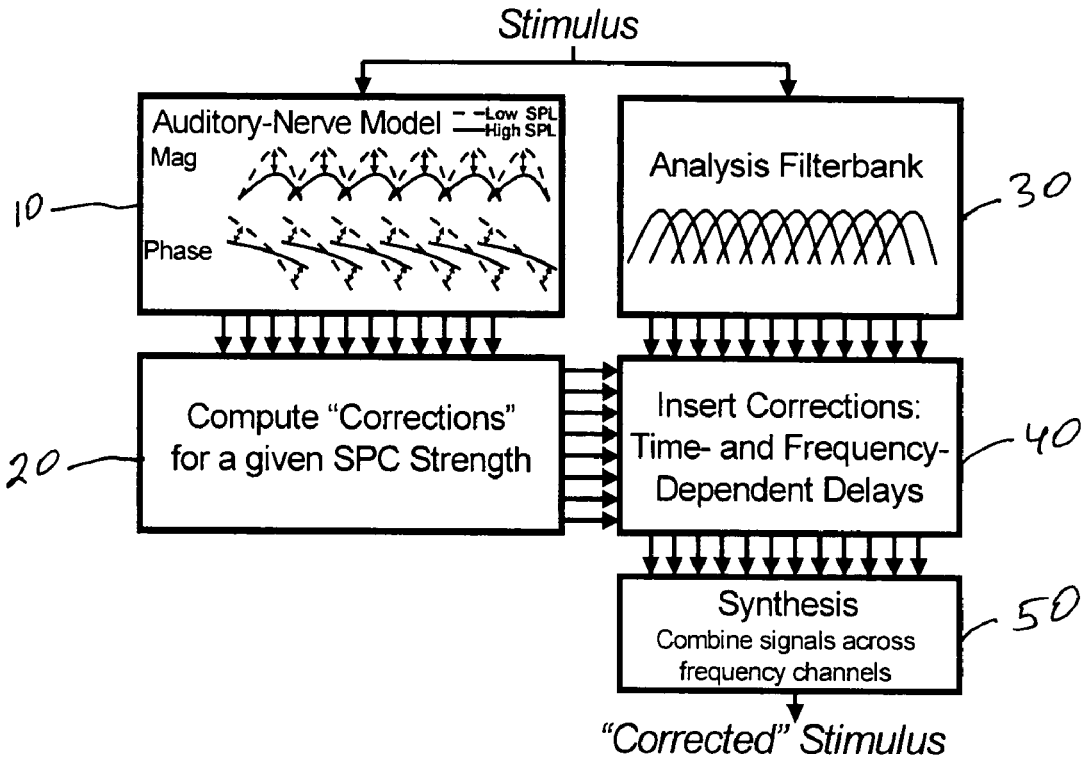
FIG. 3 shows a schematic diagram of a low-frequency SPC (spatiotemporal pattern correction) system according to an embodiment of the present invention.

Referring to FIG. 3, the SPC Signal Processing system is schematically illustrated. The control pathways (left) computed the amount of correction in phase delay and then submitted it to the analysis-synthesis filterbank (right). The dynamic time delays for each frequency channel were computed as now described. The dynamic temporal properties of healthy auditory-nerve (AN) fibers associated with a given frequency channel were computed (block 20) using a nonlinear AN model with compression (block 10). The dynamic parameters of the AN filters specify both the magnitude and phase properties of the filters as a function of time (FIG. 1). The slope of the phase vs. frequency function for a filter is proportional to its group delay (GD), or cochlear filter build-up time. The group delay (GD) is a measure of the overall delay of a signal that passes through the filter due to the tuning of the filter. Group delay (GD) is related to bandwidth; thus, this delay is a fundamental temporal property that changes with sound level in the normal ear. This calculation specifies the dynamic temporal properties of the normal ear, which serve as a reference for SPC.

The strength of the spatiotemporal signal processing correction (SPC) applied depended on the assumed loss of nonlinearity in the impaired ear. Sounds were corrected for different degrees of hearing loss; for simplicity, hearing loss was characterized in terms of the percentage of remaining nonlinear function of the impaired ear. The group delay for an impaired filter is always smaller than that of a healthy filter, because broad filters have shorter build-up times. Thus, the appropriate correction is always an inserted delay. The temporal correction was simply a fraction of the normal group delay. This dynamic temporal correction was computed for every time point during the stimulus and for each frequency channel.

The SPC system consists of two signal-processing paths as shown in FIG. 3. In one path, blocks 10 and 20, the time-varying temporal delay for each frequency channel is computed. The use of gammatone filters in the AN model results in very simple group-delay calculations, because the slope of the gammatone filter's phase-versus-frequency function is simply proportional to the gain of the filter. Gammatone filters provide an excellent description of AN fiber tuning at low and mid frequencies.

In the other path, the correction 40 (i.e., a time- and frequency-dependent delay) is inserted between the two stages 30, 50 of an analysis-synthesis filterbank. The analysis-synthesis filterbank is critical for obtaining high quality signals when combining sounds across different frequency channels. Because each frequency channel is purposefully distorted by the time-varying temporal delays, the final signal is not a reconstruction of the input, but one with spatiotemporal manipulations that are designed to correct the response of the impaired ear. Thus, only listeners with hearing loss can assess the benefit of this system. However, normal-hearing listeners were included in this study to guard against possible artifactual measures of benefit due to unintended aspects of the complex signal manipulations.

Figure 4:
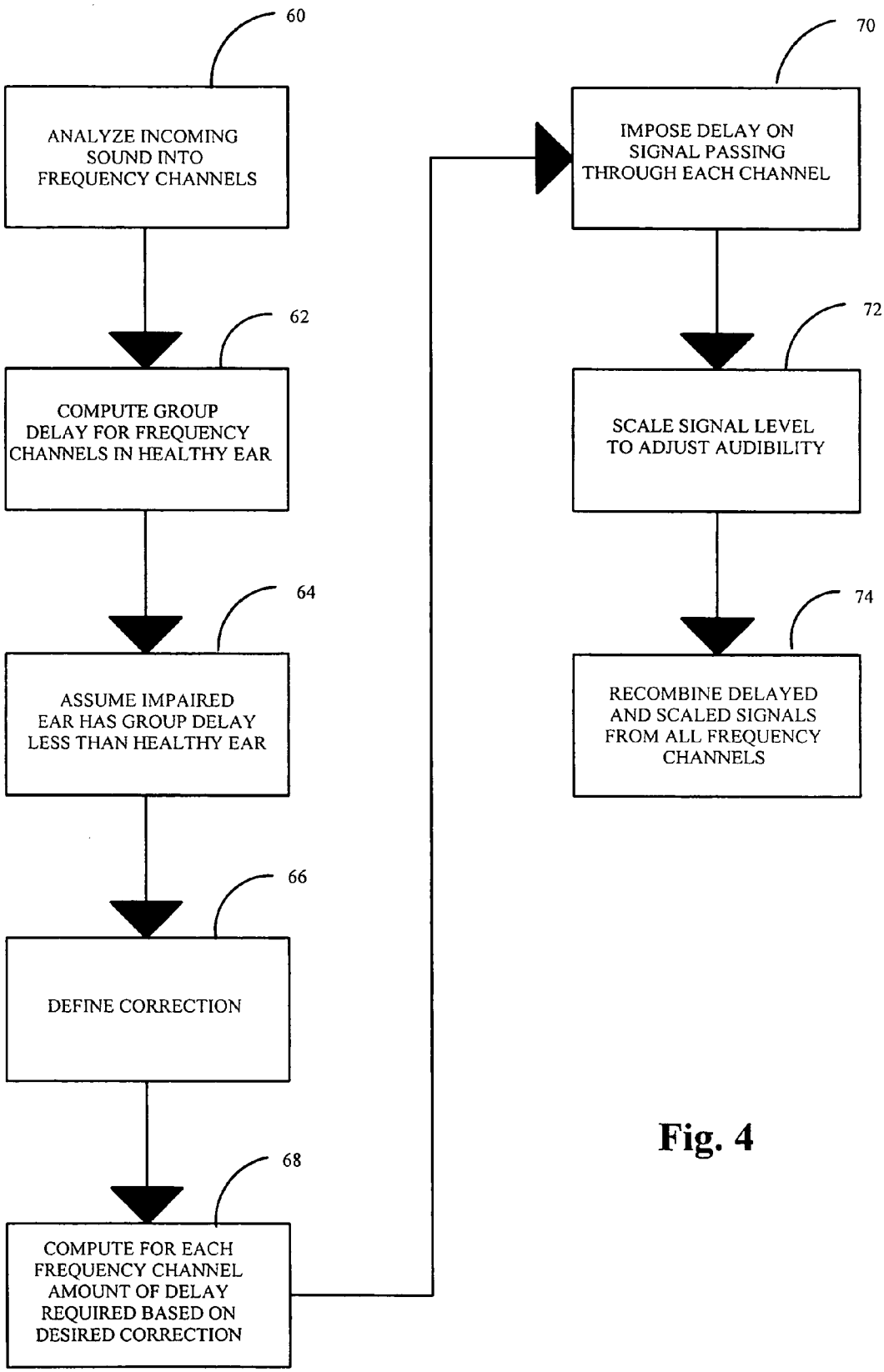
FIG. 4 shows the steps of an embodiment of the present invention.

Referring to FIG. 4, the basic implementation of an embodiment of the invention for correcting sound involves the following steps:

In step 60, analyze the incoming sound into frequency channels. This step can be accomplished using any standard filterbank analysis scheme. Because the sound will later be synthesized into a single signal, use of the front-end of an analysis-synthesis "perfect reconstruction" filterbank is an efficient strategy for this step.

In step 62, compute the group delay (GD) of each frequency channel that would be expected in a healthy ear. This group delay varies as a function of time based on the signal level for each frequency channel. This calculation is based on our knowledge of the frequency tuning and neural latencies of the healthy ear as a function of frequency and level. The details of the group-delay calculation depend upon the details of models that are used to describe the properties of the healthy ear; as more complete models for the ear are developed, the calculations can be updated.

In step 64, assume that a given impaired ear has some percentage (less than 100%) of the group delay (GD) for the healthy ear (% GD). This percentage can either be assumed to be constant across all frequencies, or can be varied with frequency. For example, a simple case would be the assumption that a given impaired ear has 80% of the healthy group delay at all frequencies. This assumption would be consistent with ~80% function of the so-called active process that can be considered to amplify sound within the healthy ear.

In step 66, define the correction that is applied as (100%)/(% GD). For the example of an ear that has 80% of the healthy group delay, the desired correction is (100%)/(80%), or a correction of 1.25. More impaired ears will have lower % GD's, and will require the strongest corrections. A healthy ear with 100% GD would require a correction of 1.0, i.e., no correction. The amount of the correction applied can be varied as a function of frequency, and can thus be fine-tuned for a particular listener.

In step 68, compute, in each frequency channel, the amount of delay required for the desired correction as a function of time for each frequency channel, based on the desired correction and the group delays computed in step 62.

In step 70, impose the delay imposed on the signal passing through each channel. As this delay is dynamic, i.e., time-varying, and varies across frequency, this process purposefully distorts the sound.

In step 72, scale the signal level to adjust audibility, either by scaling equally across all frequencies or by scaling each frequency channel independently. A compressive scheme can also be used to scale the level in each frequency channel.

In step 74, recombine the delayed and scaled signals from all frequency channels preferably using, for example, the reconstruction part of a perfect reconstruction analysis-synthesis filterbank. Because of the time-varying frequency delays and scaling imposed above, the result is of course not a perfect reconstruction, but the use of a perfect reconstruction filterbank minimizes the amount of undesired distortion that is introduced in the process of analysis and synthesis.

Stimuli were pre-processed with several different SPC strengths. Each SPC strength was proportional to a given reduction in the loss of cochlear nonlinearity. For example, to correct for an ear with 80% of normal cochlear nonlinearities, the SPC process introduced 20% of the normal time-varying delay to compensate for the impairment. Relating the percent of normal cochlear nonlinearity directly to a specific degree of hearing loss is difficult to estimate at this stage of the study. Therefore, listeners were tested for a range of SPC strengths to determine a "best" strength. SPC strength was based on 100/(% assumed normal cochlear nonlinearity); thus the SPC strength for an impaired ear with 80% of normal cochlear nonlinear function is 100/80 or 1.25. Note that in this study the same SPC strength was used to compute corrections for all frequency channels, and each listener was tested with the same range of SPC strengths, regardless of their degree of cochlear impairment.

For the results presented here, the SPC system's analysis filterbank had two filters per equivalent rectangular bandwidth (ERB) from 100 to 5000 Hz. The SPC scheme was applied to the filters with center frequencies from 100 to 2000 Hz (i.e., 36 filters). All stimuli were processed using MatLab and C with a 33-kHz sampling rate. All speech stimuli were presented at the input to the SPC system at 65 dB SPL (i.e., conversational speech level); processed sounds were presented to subjects at different SPLs (see below).

Listeners were seated in a double-walled sound booth and tested in the sound field. All speech stimuli were presented through a Dell PC and Tucker-Davis Technologies (TDT) DSP board. A programmable attenuator (TDT PA4) and Crown D-75A amplifier were used to control the stimulus level.

In Experiment 1, a two-alternative forced choice (2-AFC) paradigm was employed. Four sentences from the Hearing-in-Noise Test (HINT), spoken by a male speaker in quiet tones, served as the stimuli. Two versions of the same sentence processed at two SPC strengths with no more than a 0.15 strength difference were presented to a listener on each trial. Listeners were instructed to compare the stimuli in the two intervals and verbally report which one they preferred. They also described the basis for their preference judgments. Before the start of Experiment 1, listeners were given 18 practice trials to familiarize them with the task. Each listener was randomly presented a total of 126-432 trials of sentence pairs at 40 dB SPL speech recognition threshold (SRT). The level was adjusted when listeners reported it was not comfortable. However, the adjusted presentation levels (60-85 dB SPL) were always above the listener's SRT and below their uncomfortable loudness level (UCL). To assess if listeners' preference changed with presentation level, two listeners with hearing loss were also presented the stimuli at 45 dB SPL. No differences were observed across presentation levels and therefore data was collapsed across levels for analysis.

In Experiment 2, listeners were randomly presented with one of sixteen vowel-consonant (VC) syllables spoken by a female speaker, a subset of the Nonsense Syllable Test (NST), at five different SPC strengths (1.0, 1.075, 1.15, 1.225, and 1.3), where an SPC of 1.0 indicates that the stimulus was unprocessed. In Experiment 1, correction strengths greater than 1.3 were perceived as highly distorted by both normal-hearing listeners and listeners with hearing loss. The VC stimuli were the vowel /i/ coupled with one of the following sixteen English consonants: /p/, /b/, /t/, /d/, /k/, /g/, /f/, /v/, /θ/, /ð/, /s/, /z/, /ʃ/, /ʒ/, /m/, and /n/.

Listeners participated in a total of four runs (i.e., 1280 trials) in Experiment 2. A single run consisted of 320 trials (16 consonants×5 correction strengths×4 repetitions). The total of 1280 trials was collected in one 2-3.5 hour listening session. The VCs were presented at 66.2 dB SPL for normal-hearing listeners and varied from 81.8-97.8 dB SPL for listeners with hearing loss. Presentation levels never exceeded a listener's UCL.

Listeners were instructed to press one of sixteen buttons on a response box that corresponded to the VC they heard and verbally rate the clarity of the signal on a ten-point scale. This scale was based on the Judgment of Sound Quality (JSQ) test, where the endpoints 0 and 10 corresponded to "minimum clarity" and "maximum clarity", respectively. Clarity was chosen as the descriptor for sound quality because it was the primary factor our listeners reported using to judge the sentences they heard in Experiment 1. After each trial, listeners were given visual feedback indicating the correct vC.

Figures 5A, 5B, 5C:
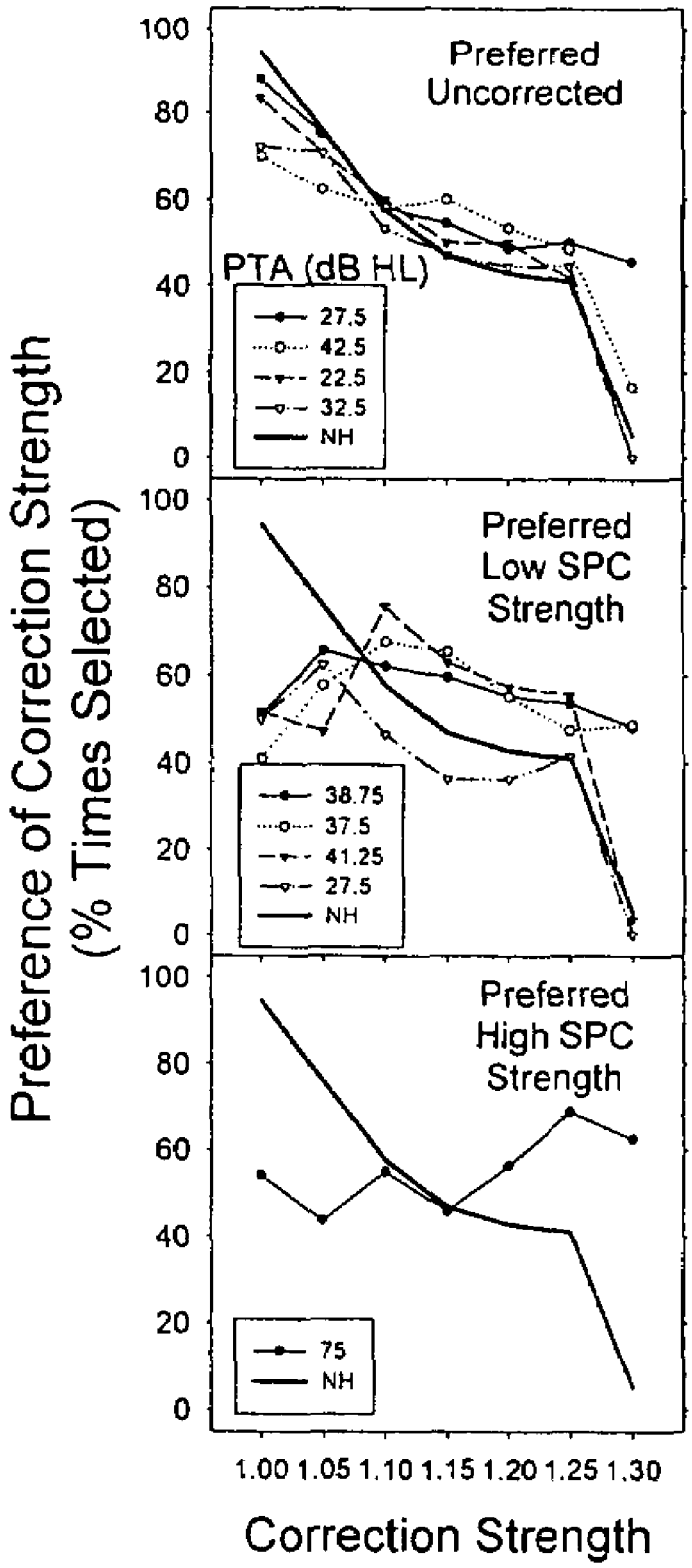
FIGS. 5A-5C show the preference for SPC strength for nine listeners with hearing loss.

Referring to FIGS. 5A-5C, the results from Experiment 1 show the preference for SPC strength for 9 listeners with hearing loss. The percentage of times that sentences with each SPC strength were preferred in pair-wise tests is plotted as a function of SPC strength. The bold solid lines (repeated in all three figures) are average preferences for three normal-hearing listeners. The three panels show results for three groups of listeners with hearing loss. FIG. 5A shows that four listeners with hearing loss preferred uncorrected stimuli (SPC strength=1.0). FIG. 5B shows that four listeners with hearing loss preferred corrected stimuli with low SPC strengths (1.05-1.1). FIG. 5C shows that one listener with severe hearing loss preferred a high SPC strength (1.25). Pure tone averages (PTAs ) of 500, 1000, 2000, and 4000 Hz are shown for each listener in the legends.

Results from the listeners' performance on the sentence quality preference task are reported as the percent of times a listener preferred a specific SPC strength, because selection rate is a valid manner of analysis in a paired-comparison task. As SPC strength increased, normal-hearing listeners' preference scores decreased, showing a preference for the unprocessed sentences over the SPC-processed sentences. This same pattern was observed in only one of the nine listeners with hearing loss. Six listeners with hearing loss showed little difference between their preference for unprocessed and minimally processed stimuli. The two listeners whose PTAs were 41 and 75 dBHL preferred 1.1 and 1.3 SPC processed sentences, respectively. These results suggest that listeners with more hearing loss prefer stronger SPC strengths. It should be noted that PTA was calculated based on the average of a listener's hearing thresholds at 0.5, 1, 2, and 4 kHz. There was a significant positive correlation between listeners' PTAs and preferred correction strength ($r=0.894$, $p=0.0164$). However, the correlation between PTA and correction strength was not significant when the listener with severe hearing loss (PTA=75 dB HL) was removed from the analysis. Given this limited set of listeners it is difficult to make any strong conclusion about the relationship between degree of hearing loss and preferred SPC strength, but the results are suggestive.

Listeners were asked to describe the basis for their judgments. All listeners reported that the clarity of the stimuli determined their preferences. Clarity has been reported previously as the most significant factor in determining overall sound quality and hearing aid satisfaction. Some listeners also reported that their preference for certain stimuli was related to the "fullness" and/or "loudness" of the sound.

Figures 6A, 6B:
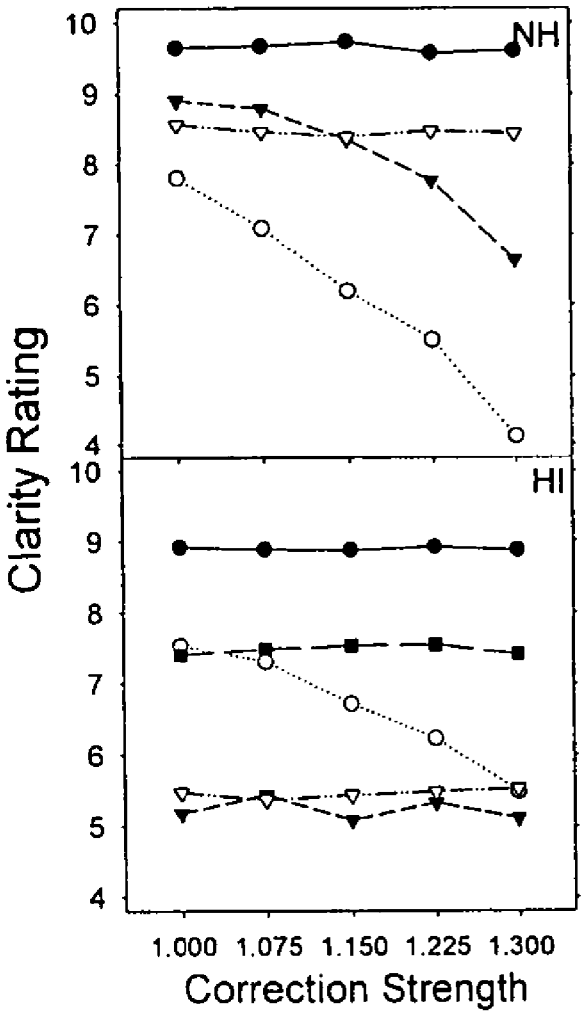
FIGS. 6A-6B show the clarity rating as a function of correction for 16 nonsense syllable test (NST) vowel-consonants (VCs) in four normal-hearing listeners.

Referring to FIGS. 6A-6B, the results from Experiment 2 are shown. The clarity rating as a function of correction for 16 NST VCs in four normal-hearing listeners (NH, FIG. 6A) and five listeners with hearing loss (HI, FIG. 6B) are shown. The VCs differed in the ending-consonant phonemes. The presentation level was fixed at each listener's most comfortable hearing level (MCL). Each line with a different symbol represents the data from one listener. Data were averaged across 16 VCs.

Listeners' clarity ratings of the VC stimuli on a ten-point scale are shown in FIGS. 6A-6B. Clarity ratings for two normal-hearing listeners decreased monotonically as SPC strength increased, which is similar to how the normal-hearing listeners judged the quality of the sentences in Experiment 1. The other two normal-hearing listeners judged the clarity of the VCs to be the same across all five SPC strengths. No difference in clarity ratings across SPC strengths was observed by four of the five listeners with hearing loss. However, normal-hearing listeners' overall clarity ratings of the unprocessed stimuli (SPC=1.0) were higher than for listeners with hearing loss. VC clarity ratings for the youngest listener (24 years old) in this study had clarity ratings that decreased as SPC strength was increased. Interestingly, this listener's overall percent correct VC recognition score was more similar to the normal-hearing listeners' scores than to the listeners with hearing loss.

Figures 7A, 7B:
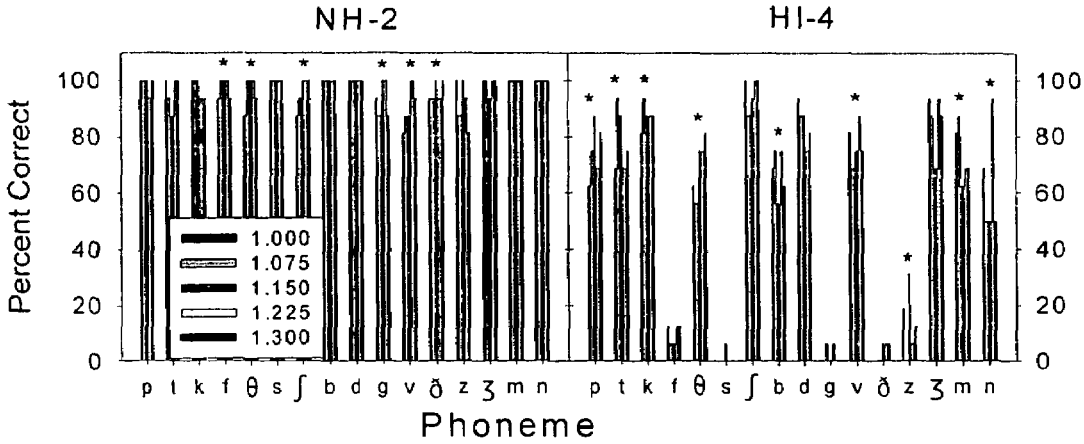
FIGS. 7A-7B show phoneme-recognition scores in one normal-hearing listener (NH-2, FIG. 7A) and one listener with hearing loss (HI-4, FIG. 7B).

Referring to FIGS. 7A-7B, phoneme-recognition scores in one normal-hearing listener (NH-2, FIG. 7A) and one listener with hearing loss (HI-4, FIG. 7B) are shown. Each vertical bar within a cluster of five bars represents one recognition score for a specific phoneme. Each set of bars shows scores for SPC strengths varying from 1.0 (uncorrected) to 1.3, from left to right. Each bar represents the results for 16 trials at a given stimulus condition. The legend shows the correction strengths corresponding to the bars of different shades.

The individual phoneme scores for Listener NH-2 and HI-4 are typical of those obtained by the normal-hearing listeners and listeners with hearing loss, respectively. The asterisks indicate phonemes that were correctly identified more often with SPC processing than without. Normal-hearing listeners obtained high recognition scores for all 16 phonemes in the uncorrected condition. This ceiling effect might be why there were little to no improvements in scores for the SPC conditions. However, the SPC processing did not decrease normal-hearing listeners' overall recognition scores. For HI-4, the listener with hearing loss, SPC improved the scores for phonemes /p/, /t/, /θ/, /z/, and /n/) by more than 10-30%. Other phonemes scores (e.g., /s/ and /ð/) were barely above the level of chance (i.e., 6.25%). No single correction strength improved the recognition of all phonemes.

Figure 8:
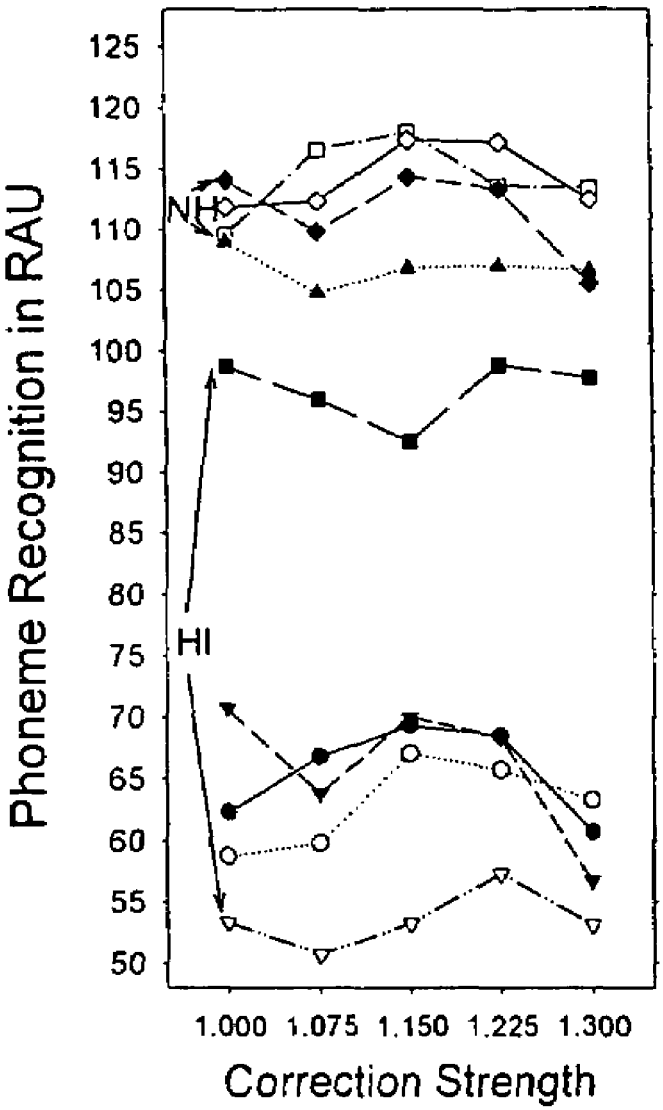
FIG. 8 shows phoneme recognition in rationalized arcsine units (RAU) as a function of correction strength in four normal-hearing listeners (NH) and five listeners with hearing loss (HI).

Referring to FIG. 8, phoneme recognition in rationalized arcsine units (RAU) as a function of correction strength in four normal-hearing listeners (NH) and five listeners with hearing loss (HI) is shown. Each line with a different symbol represents the data from one listener. Arrows bracket the results for each group of listeners. Data were averaged across 16 phonemes. Overall percent correct recognition scores were transformed to RAU to stabilize variance. Normal-hearing listeners scored over 90% regardless of SPC strength, whereas only one listener with hearing loss performed above 70% for any SPC strength. This listener was the youngest listener (24 years old) who has worn binaural hearing aids since pre-school. Although the differences in percent correct scores across different SPC strengths are small, several listeners with hearing loss obtained their highest recognition score with SPC strengths of 1.15 or 1.225. There was no significant correlation between PTA of 500, 1000 and 2000 Hz for listeners with hearing loss and the SPC strength that yielded their highest overall recognition score in RAU (r=0.560, p=0.326). Again, the range of PTAs for this group of listeners with hearing loss was limited (i.e., 36.7-53.8 dB HL).

Confusion matrices of listeners' errors on the VC intelligibility test were subjected to Sequential Information Analysis (SINFA). The proportion of information transmitted for the acoustic features, including voicing, place and manner, are reported in Table 2. For most subjects the percent of information transmitted remained unchanged or was slightly higher with some level of SPC correction. Two exceptions included HI-9, who showed a large increase in voicing information transmitted at the 1.25 SPC strength, and HI-6, who showed a large decrease in manner information transmitted at the 1.3 SPC strength. These findings suggest that SPC processing does not have any one systematic effect on the main features of speech, but could have a more global effect on phoneme perception.

TABLE 2

Results from SINFA analysis for listeners with normal hearing (NH) and listeners with hearing loss (HI) on a VC recognition task performed at five different SPC strengths.

| | SPC | NH-2 | NH-3 | NH-4 | NH-5 | HI-4 | HI-6 | HI-7 | HI-8 | HI-9 |
|---|---|---|---|---|---|---|---|---|---|---|
| | | | | | Voicing | | | | | |
| Information Transmitted | 1.000 | 0.884 | 0.797 | 0.759 | 0.838 | 0.838 | 0.861 | 0.967 | 0.863 | 0.554 |
| | 1.075 | 0.887 | 0.762 | 0.783 | 0.933 | 0.741 | 0.797 | 0.940 | 0.839 | 0.598 |
| | 1.150 | 0.966 | 0.823 | 0.789 | 0.917 | 0.901 | 0.860 | 0.967 | 0.805 | 0.575 |
| | 1.225 | 0.967 | 0.797 | 0.751 | 0.907 | 0.818 | 0.863 | 0.943 | 0.782 | 0.650 |
| | 1.300 | 0.823 | 0.800 | 0.751 | 0.860 | 0.966 | 0.800 | 1.000 | 0.875 | 0.618 |
| | | | | | Place | | | | | |
| Information Transmitted | 1.000 | 0.918 | 0.971 | 0.939 | 0.917 | 0.376 | 0.550 | 0.766 | 0.511 | 0.450 |
| | 1.075 | 0.921 | 0.918 | 0.885 | 0.962 | 0.401 | 0.517 | 0.745 | 0.554 | 0.460 |
| | 1.150 | 0.954 | 0.950 | 0.918 | 0.966 | 0.353 | 0.555 | 0.690 | 0.548 | 0.505 |
| | 1.225 | 0.965 | 0.965 | 0.918 | 0.935 | 0.446 | 0.517 | 0.775 | 0.532 | 0.747 |
| | 1.300 | 0.945 | 0.886 | 0.921 | 0.933 | 0.393 | 0.487 | 0.755 | 0.527 | 0.453 |
| | | | | | Manner | | | | | |
| Information Transmitted | 1.000 | 0.903 | 0.987 | 0.948 | 0.921 | 0.618 | 0.796 | 0.981 | 0.725 | 0.742 |
| | 1.075 | 0.913 | 0.962 | 0.923 | 0.979 | 0.607 | 0.780 | 0.967 | 0.782 | 0.703 |
| | 1.150 | 0.916 | 0.981 | 0.913 | 0.985 | 0.603 | 0.825 | 0.985 | 0.775 | 0.709 |
| | 1.225 | 0.981 | 1.000 | 0.943 | 0.919 | 0.658 | 0.713 | 1.000 | 0.754 | 0.714 |
| | 1.300 | 0.879 | 0.928 | 0.935 | 0.952 | 0.707 | 0.160 | 1.000 | 0.823 | 0.661 |

Given the large variability in SPC performance observed across listeners with hearing loss, test-retest reliability was examined for one listener with hearing loss. This listener was randomly selected and retested on the same protocol four months after the listener's original test. A simple correlation test indicated good repeatability across sessions in both quality rating (r=0.903, p<0.001) and phoneme recognition (r=0.907, p<0.001).

A physiologically-based signal-processing strategy, SPC, is described in this study as a potential new approach to enhance recognition and perceived quality of speech in listeners with hearing loss. SPC introduces different delays across frequency channels of a signal in an attempt to "correct" the abnormal spatiotemporal response pattern of the impaired ear without changing the magnitude spectrum of the sound. Results from this current study show that SPC improves the sound quality of sentences for most listeners with moderate hearing loss while retaining and in some cases improving the intelligibility of phonemes. Normal-hearing listeners and listeners with mild hearing loss tend to prefer the unprocessed sentences.

Normal-hearing listeners' performance on the preference task in Experiment 1 differed from the normal-hearing listeners' clarity ratings in Experiment 1. These differences can be attributed to the test paradigm and stimuli that were used. For example, in Experiment 1 listener's judgments of sentence quality were obtained using a 2-AFC task, while in Experiment 2 a categorical rating scale was used to judge the clarity of nonsense syllables. A categorical scale might not have been sensitive enough to measure small changes in phoneme clarity, especially for small differences in SPC strengths. Eisenberg et al. ("Subjective judgments of speech clarity measured by paired comparisons and category rating", *Ear and Hearing,* 18, 294-306 (1997)) demonstrated that clarity judgments based on a categorical rating system are less sensitive than a paired-comparison scheme, at least for listeners with hearing loss. In addition, neither sentences nor NST are the ideal stimuli. Continuous discourse has been reported to be the most appropriate stimulus in a quality-rating task for speech, but cannot be used in an SPC experiment until the speech signal can be SPC processed in real time. However, one advantage of using NST stimuli is that it allowed us to analyze the specific types of improvements and errors related to the SPC processing.

A ceiling effect was observed for the normal- hearing listeners' performance on the VC recognition task. Although this precluded the observation of any considerable improvements in phoneme recognition scores, it cannot explain the lack of any decline in performance as SPC strength increased. It was somewhat surprising that adding the temporal distortions to a normal ear did not have a more negative impact on the normal hearing listeners' recognition scores. Most listeners with hearing loss showed some improvement in their processed recognition scores compared to their unprocessed scores. The degree of this improvement was small. However, the SPC strategy was only applied to frequencies below 2000

Hz and many of the listeners who participated in this study had more hearing loss in the higher than lower frequencies.

Although listeners who benefited the most from SPC had a relatively flat hearing loss, listeners with high-frequency hearing loss also received some benefit from the SPC. There is evidence that a high-frequency hearing loss does influence low-frequency perception of speech (Horwitz, Dubno, & Ahlstrom, "Recognition of low-pass-filtered consonants in noise with normal and impaired high-frequency hearing", *Journal of the Acoustic Society of America,* 111, 409-4176 (2002)). In fact, Doherty & Lutfi reported in "Level discrimination of single tones in a multitone complex by normal-hearing and hearing-impaired listeners", *Journal of the Acoustic Society of America,* 105, 1831-1840 (1997) that listeners with high-frequency sloping sensorineural loss had difficulty weighting low-frequency components of a complex signal in a selective listening task. Thus, signal-processing schemes targeted at low frequencies may still bring benefit to listeners with hearing loss, regardless of the configuration of their loss.

Interestingly, based on SINFA analysis, SPC did not consistently improve any single acoustic feature of speech. We predicted that the improvement in phoneme recognition would have been associated with an enhancement in some speech cues that would result in a consistent improvement in specific phonemes. However, the improvements and decline in phoneme recognition varied across listeners. Because SPC was not applied to frequencies above 2000 Hz, its effect on speech cues such as noise bursts for plosive identification and frication noise for fricative identification is limited. SPC might have a greater effect on other speech cues such as formant transitions, which are more predominant in low to mid frequencies. Formant transitions are essential for correct identification of plosives, fricatives, and nasals. Future experiments should include a larger set of speech stimuli to help identify which acoustic cues that are most affected by SPC.

One of the challenges in the practical application of SPC is to estimate the loss of nonlinear properties in the impaired ear in an effort to identify the specific SPC strength that would maximally compensate for a given loss, which is not equivalent to audiometric hearing loss. The loss in group delay in an impaired ear could signify other pathologies related to the loss of nonlinearity. In this study, albeit a small group of listeners, severity of hearing loss only served as a modest indicator of preferred correction strength. A larger study with groups of subjects having a range of PTAs from mild to severe is needed to assess the relationship between PTA and SPC strength. To avoid SPC strengths being arbitrarily selected, as was done in the current study, a real-time adjustable SPC "tuner" would be the method of choice to determine a listener's most appropriate correction strength. Speech recognition scores and quality ratings would likely improve with better control over the SPC strength selected for individual listeners. Because group delay is closely associated with cochlear nonlinearity, another way to reach the optimal SPC strength for a specific hearing loss is to explore the relationship between group delay and cochlear biomechanics. For example, otoacoustic emissions (OAEs) are an indirect measure of cochlear nonlinearity. Deeper insight might be gained by investigating the connection between OAEs and listeners' preferred and most beneficial SPC strengths. However, a change in group delay is only one aspect of the healthy nonlinear cochlear.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A method for correcting sound for the hearing impaired, comprising the steps of:

(a) analyzing an incoming sound into a plurality of signals, one of said signals in each of a plurality of frequency channels;

(b) computing a group delay (GD) of each of said frequency channels that is expected in a healthy ear;

(c) defining a correction as (100%)/(% GD), where (% GD) is defined as a percentage less than 100% of the group delay (GD) that a given impaired ear has compared to the group delay of the healthy ear;

(d) computing, in each of said frequency channels, an amount of delay required for the correction as a function of time for each of said frequency channels, based on the correction from step (c) and the group delays computed in step (b);

(e) imposing the amount of delay on each signal passing through each frequency channel;

(f) scaling the signal level of each signal to adjust audibility; and (g) recombining the delayed and scaled signals from all frequency channels into an outgoing sound.

2. A method according to claim 1, wherein the step of imposing further includes varying the amount of the correction applied as a function of frequency to fine-tune the correction for a particular listener.

3. A method according to claim 2, wherein the step of scaling is performed by scaling equally across all frequencies.

4. A method according to claim 3, wherein the percentage of group delay for the impaired ear is constant across all frequencies.

5. A method according to claim 3, wherein the percentage of group delay for the impaired ear varies with frequency.

6. A method according to claim 2, wherein the step of scaling is performed by scaling each frequency channel independently.

7. A method according to claim 6, wherein the percentage of group delay for the impaired ear is constant across all frequencies.

8. A method according to claim 6, wherein the percentage of group delay for the impaired ear varies with frequency.

9. A method according to claim 1, wherein the step of scaling is performed by scaling equally across all frequencies.

10. A method according to claim 1, wherein the step of scaling is performed by scaling each frequency channel independently.

11. A method according to claim 1, wherein the percentage of group delay for the impaired ear is constant across all frequencies.

12. A method according to claim 1, wherein the percentage of group delay for the impaired ear varies with frequency.

13. A method according to claim 1, further comprising the step of implementing the method in a hearing aid.

14. A program storage device readable by a machine, tangibly embodying a program of instructions executable by the machine to perform method steps for correcting sound for the hearing impaired, said method steps comprising:

(a) analyzing an incoming sound into a plurality of signals, one of said signals in each of a plurality of frequency channels;

(b) computing a group delay (GD) of each of said frequency channels that is expected in a healthy ear;

(c) defining a correction as (100%)/(%GD), where (%GD) is defined as a percentage less than 100% of the group delay (GD) that a given impaired ear has compared to the group delay of the healthy ear;

(d) computing, in each of said frequency channels, an amount of delay required for the correction as a function of time for each of said frequency channels, based on the correction from step (c) and the group delays computed in step (b);

(e) imposing the amount of delay on each signal passing through each frequency channel;

(f) scaling the signal level of each signal to adjust audibility; and (g) recombining the delayed and scaled signals from all frequency channels into an outgoing sound.

15. A program storage device according to claim 14, wherein the device is incorporated within a hearing aid.

16. An article of manufacture comprising:

a computer usable medium having computer readable program code means embodied therein for correcting sound for the hearing impaired, the computer readable program code means in said article of manufacture comprising:

computer readable program code means for causing a computer to analyze an incoming sound into a plurality of signals, one of said signals in each of a plurality of frequency channels;

computer readable program code means for causing the computer to compute a group delay (GD) of each of said frequency channels that is expected in a healthy ear;

computer readable program code means for causing the computer to define a correction as (100%)/(%GD), where (%GD) is defined as a percentage less than 100% of the group delay (GD) that a given impaired ear has compared to the group delay of the healthy ear;

computer readable program code means for causing the computer to compute, in each of said frequency channels, an amount of delay required for the correction as a function of time for each of said frequency channels;

computer readable program code means for causing the computer to impose the amount of delay on each signal passing through each frequency channel;

computer readable program code means for causing the computer to scale the signal level of each signal to adjust audibility; and computer readable program code means for causing the computer to recombine the delayed and scaled signals from all frequency channels into an outgoing sound.

17. An article according to claim 16, wherein the article is incorporated into a hearing aid.

* * * * *